US009264823B2

(12) United States Patent
Bajic et al.

(10) Patent No.: US 9,264,823 B2
(45) Date of Patent: Feb. 16, 2016

(54) AUDIO HEADSET WITH AUTOMATIC EQUALIZATION

(71) Applicants: Vladan Bajic, San Francisco, CA (US); Andrew P. Bright, San Francisco, CA (US)

(72) Inventors: Vladan Bajic, San Francisco, CA (US); Andrew P. Bright, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 616 days.

(21) Appl. No.: 13/631,475

(22) Filed: Sep. 28, 2012

(65) Prior Publication Data

US 2014/0093090 A1 Apr. 3, 2014

(51) Int. Cl.

| | |
|---|---|
| ***H04R 25/00*** | (2006.01) |
| ***H04R 3/04*** | (2006.01) |
| ***H04R 1/10*** | (2006.01) |
| ***H04R 5/04*** | (2006.01) |
| *H04R 5/033* | (2006.01) |

(52) U.S. Cl.

CPC ..... *H04R 25/505* (2013.01); *H04R 1/1083* (2013.01); *H04R 3/04* (2013.01); *H04R 5/04* (2013.01); *H04R 1/1016* (2013.01); *H04R 5/033* (2013.01); *H04R 2430/03* (2013.01); *H04R 2460/05* (2013.01)

(58) Field of Classification Search

CPC ..... H04R 3/04; H04R 5/033

USPC ..... 381/74

See application file for complete search history.

(56) References Cited

U.S. PATENT DOCUMENTS

| | | | | |
|---|---|---|---|---|
| 8,218,802 | B2 | 7/2012 | Arndt et al. | |
| 2003/0145025 | A1 * | 7/2003 | Allred et al. | 708/320 |
| 2004/0032959 | A1 * | 2/2004 | Montag et al. | 381/103 |
| 2004/0196992 | A1 * | 10/2004 | Ryan | 381/312 |
| 2011/0069852 | A1 | 3/2011 | Arndt et al. | |
| 2011/0116643 | A1 * | 5/2011 | Tiscareno et al. | 381/58 |
| 2011/0142247 | A1 | 6/2011 | Fellers et al. | |
| 2012/0076334 | A1 | 3/2012 | Anderson | |

* cited by examiner

*Primary Examiner* — Davetta W Goins
*Assistant Examiner* — Daniel Sellers
(74) *Attorney, Agent, or Firm* — Blakely Sokoloff, Taylor & Zafman LLP

(57) ABSTRACT

An accessory having an earbud for insertion into a user's ear is disclosed. The earbud may include a speaker and a microphone in which the speaker plays an audio signal for the user and the microphone receives the audio signal. The accessory includes a processor that is coupled to the speaker and the microphone to execute various operations. For example, the operations may include: determining a ratio of an energy estimation of the speaker audio signal to an energy estimation of the audio signal received by the microphone; determining a gain for the speaker audio signal based upon the ratio; based upon the gain, selecting a shelving filter; and applying the shelving filter to the speaker audio signal.

15 Claims, 5 Drawing Sheets

AUDIO HEADSET WITH AUTOMATIC EQUALIZATION

FIELD

An embodiment of the invention relates to an audio headset with automatic equalization.

BACKGROUND

It is often desirable to use headphones when listing to music and other audio material. For example, users commonly use headphones when listening to music that is being played back from a portable music player. Over-the-ear headphones are sometimes used, particularly in environments in which size is not a major concern. When a compact size is desired, users often use in-ear headphones (sometimes termed "earbuds"). Earbuds are popular because they form a seal in the ear that helps to reduce ambient noise while retaining the compact size of other in-ear designs.

When earbuds are used by different people, there are variances in frequency response at the Drum Reference Point (DRP). These variances may be caused by different amounts of occlusion that the headphone creates when it is placed in the user's ear, which may be the result of the following factors: 1) inconsistency in the positioning of the headphone in the user's ear; 2) different sizes/shapes of the user's ears; and 3) the headphone moving in the user's ear due to stress, shaking, jogging, etc. Accordingly, it would be beneficial to compensate for these variances and provide a consistent response at the DRP.

SUMMARY

An embodiment of the invention relates to an accessory having an earbud for insertion into a user's ear. The earbud may include a speaker and a microphone in which the speaker plays an audio signal for the user and the microphone receives the audio signal. The accessory may include a processor that is coupled to the speaker and the microphone to execute various operations. For example, the operations may include: determining a ratio of an energy estimation of the speaker audio signal to an energy estimation of the audio signal received by the microphone; determining a gain for the speaker audio signal based upon the ratio; based upon the gain, selecting a shelving filter; and applying the shelving filter to the speaker audio signal.

By applying the shelving filter to the speaker audio signal, an equalized speaker audio signal is sent out in the user's ear to compensate for gain/loss due to occlusions associated with the headphone and the user's ear such that these factors are compensated for and the user receives the intended speaker audio signal.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments of the invention with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Electronic devices such as computers, cellular telephones, and portable music players are often connected to headphones and other accessories with speakers. In a typical arrangement, a headset has a cable that is plugged into an audio jack in an electronic device. The headset has speakers that are used to play back audio material from the electronic device. For example, the headset may play a song for a user of a music player or may be used to present telephone call audio signals to the user of a cellular telephone.

Earbud headsets have speakers that are housed in earbuds. The earbuds may have elastomeric features that conform to the ear canal of a user's ear. For example, an earbud may have a foam structure or soft plastic fins that help seat the earbud in the user's ear. When properly positioned in the user's ear, the earbud forms a seal with the user's ear. The seal blocks ambient noise. The seal also forms an enclosed cavity adjacent to the ear.

Figure 1:
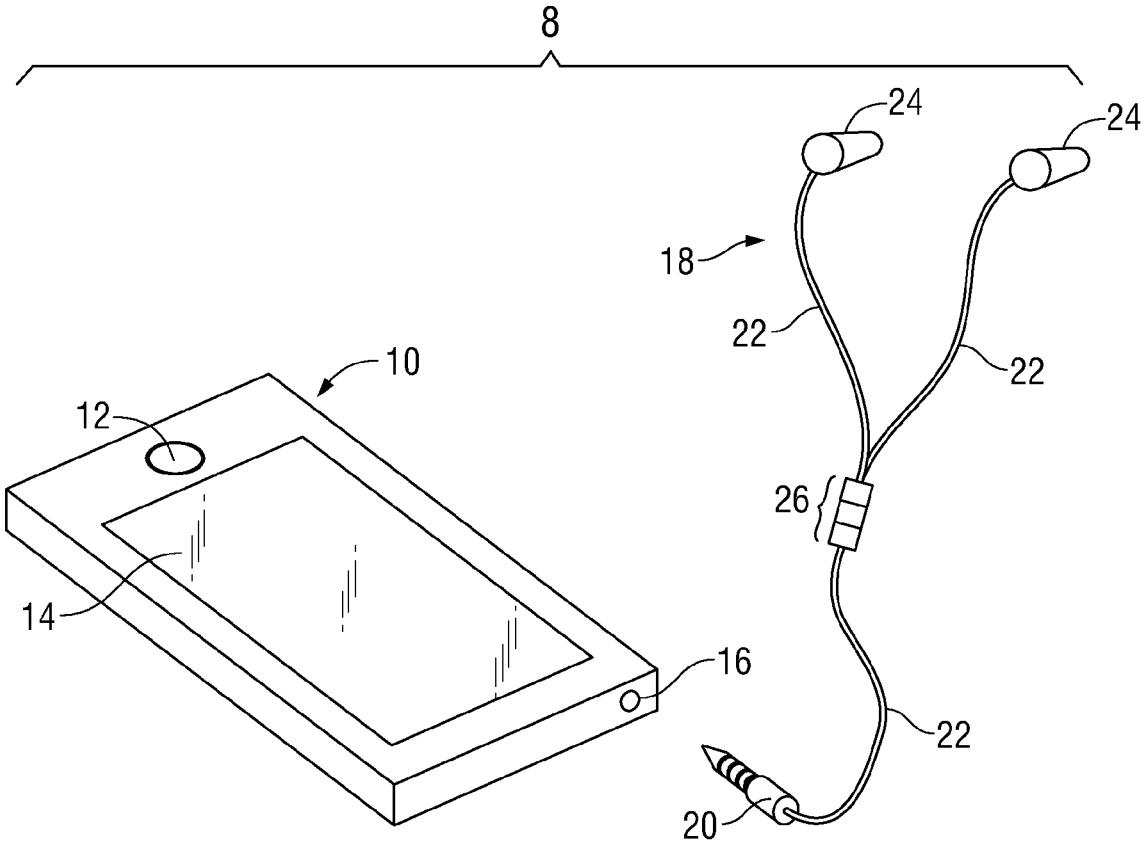
FIG. 1 is a perspective view of an illustrative system that includes an electronic device and an associated headset in accordance with an embodiment of the invention.

For example, with reference to FIG. 1, a system 8 is shown that may include an electronic device 10 and may include an accessory such as headset 18. Device 10 may be a cellular telephone with media playback capabilities, a portable computer such as a tablet computer or laptop computer, a desktop computer, a television, an all-in-one computer that is housed in the case of a computer monitor, television equipment, an amplifier, or any other suitable electronic equipment. Device 10 may have input-output components such as button 12 and display 14. Display 14 may be a touch screen or a display without touch capabilities.

Accessory 18 may be a headset or other device that includes speakers. Accessory 18 may, for example, be a headset that includes a voice microphone for handling telephone calls, a pair of stereo headphones that contains speakers but that does not include a voice microphone, a single-speaker device such as a wireless earpiece, hearing aid, or monaural headphone, etc. Arrangements in which accessory 18 is implemented using one or more earbud-styles speakers (i.e., arrangements in which accessory 18 is a set of earbud headphones) are sometimes described herein as an example.

In the example of FIG. 1, headset 18 has earbuds 24. Button assembly 26 may include user-controlled buttons and an optimal voice microphone. Circuitry for headset 18 may be housed in button assembly 26 or in earbuds 24 (as examples). If desired, headset 18 may have different types of user input interfaces (e.g., interfaces based on microphones, touch screens, touch sensors, switches, etc.). The inclusion of button assembly 26 in headset 18 of FIG. 1 is merely illustrative.

Cables such as cables 22 may be used to interconnect earbuds 24, button assembly 26, and plug 20. Plug 20 may be implemented using an audio plug (e.g., a 3.5 mm tip-ring-ring-sleeve or tip-ring-sleeve connector), using a digital connector (e.g., a universal serial bus connector or a 30-pin data port connector), or using any other suitable connector. Connector 20 may have contacts that mate with corresponding contacts in port 16. For example, if connector 20 is a four-contact 3.5 mm audio plug, port 16 may be a mating four-contact 3.5 mm audio jack.

Figure 2:
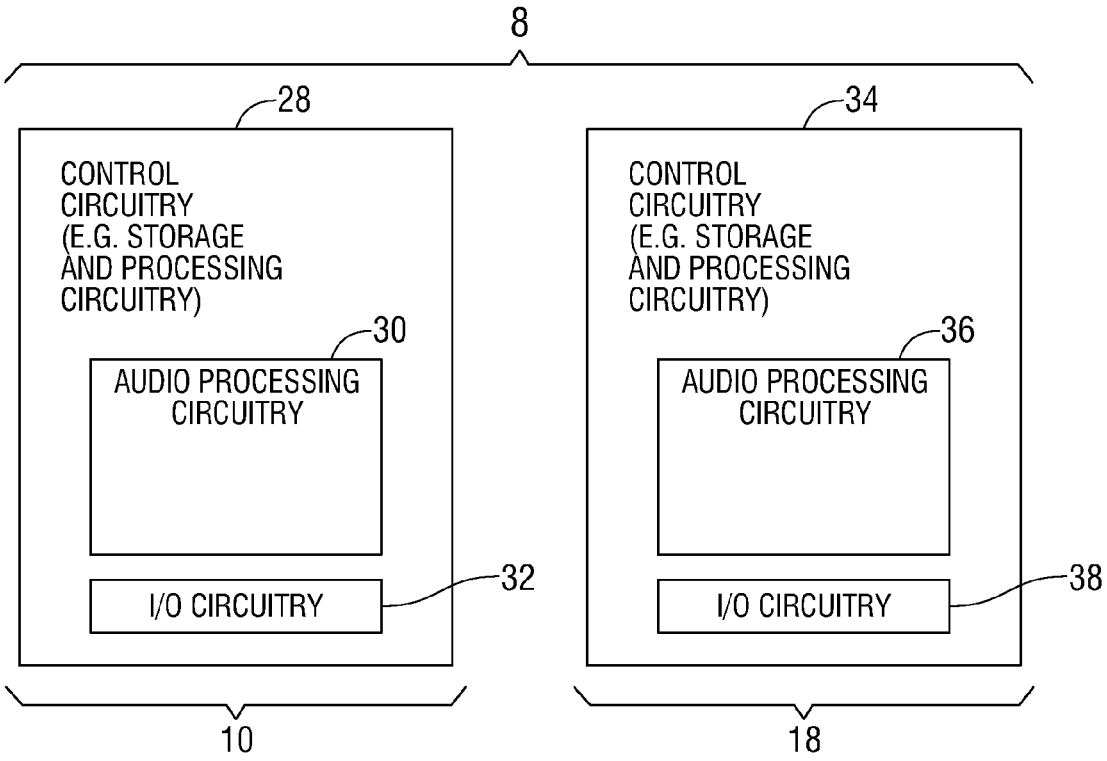
FIG. 2 is a block diagram showing circuitry that may be used in an electronic device and headset accessory in a system of the type shown in FIG. 1 in accordance with an embodiment of the invention.

Circuitry that may be used in device 10 and headset 18 of FIG. 1 is shown in FIG. 2. As shown in FIG. 2, device 10 may include control circuitry 28 and accessory 18 may include control circuitry 34. Circuitry 28 and 34 may include storage and processing circuitry that is based on microprocessors, application-specific integrated circuits, audio chips (codecs), video integrated circuits, microcontrollers, digital signal processors (e.g., audio digital signal processors), memory devices such as solid state storage, volatile memory (e.g., random-access memory), and hard disk drives, etc.

As shown in FIG. 2, circuitry 28 may, if desired, include audio processing circuitry 30. Circuitry 34 may also include audio processing circuitry 36, if desired. Circuitry 28 may include input-output circuitry 32. Circuitry 34 may also include input-output circuitry 38. Input-output circuitry 32 and 38 may include user input devices such as buttons, touch pads, track pads, keyboards, switches, microphones, and touch screens. Input-output circuitry may also include output devices such as displays, speakers, and status indicators. Input-output circuitry 32 and 38 may include communications circuitry that is associated with ports such as port 16 of device 10 and plug 20 of accessory 18. This communications circuitry may be used to transmit analog and/or digital signals between device 10 and headset 18. Cables such as cable 22 and connectors such as connectors 16 and 20 may form a communications path that can be used in conveying signals between device 10 and headset 18. The communications path may be used to transmit audio from circuitry 28 to earbuds 24 during playback operations.

As one example, each of the earbuds 24 may include a speaker and a microphone that is placed in a user's ear. The speaker plays an audio signal for the user and the microphone receives the audio signal. The audio processing circuitry 36 of headset 18 is coupled to both the speaker and the microphone. The audio processing circuitry 36 (e.g., hereinafter referred to as processor) may execute operations including: determining a ratio of an energy estimation of the speaker audio signal to an energy estimation of the audio signal received by the microphone; determining a gain for the speaker audio signal based upon the ratio; and based upon the gain, selecting a shelving filter. The processor 36 further applies the shelving filter to the speaker audio signal. By applying the shelving filter to the speaker audio signal an equalized speaker audio signal is sent out in the user's ear to compensate for gain/loss due to occlusions associated with the headphone and the user's ear. For example, the shelving filter may be a low frequency infinite impulse response (IIR) filter.

In general, this method of adaptive of adaptive equalization (EQ) includes a microphone integrated into the earbud in front of the speaker in order to detect the frequency response in the ear. An error microphone signal is compared to the signal being sent to the speaker. Based on these two signals, an appropriate EQ curve is computed and applied to the signal being sent to the speaker.

Figure 3:
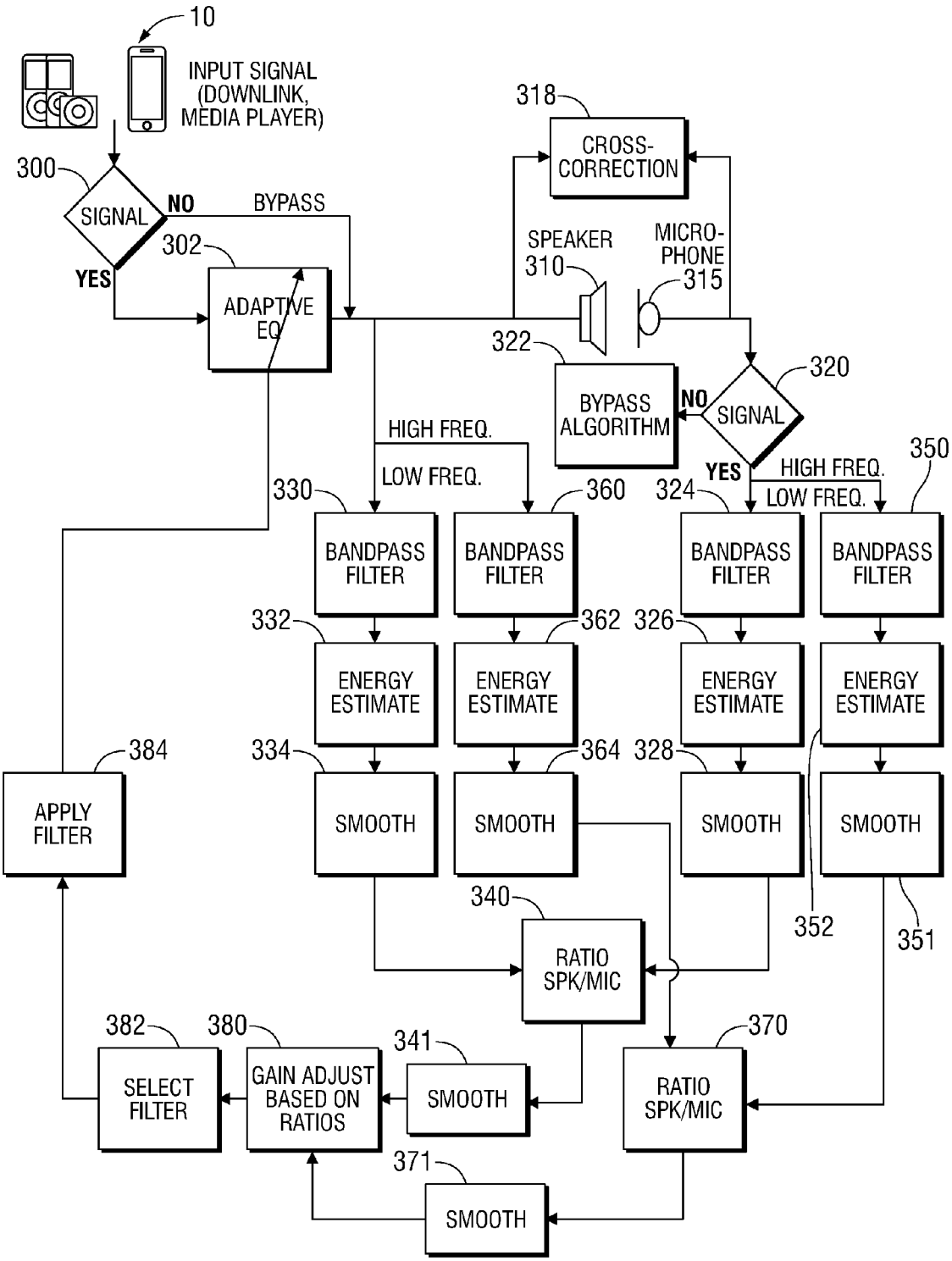
FIG. 3 is a flow diagram illustrating a process of adaptive equalization (EQ) for an earbud, according to one embodiment of the invention.

With additional reference to FIG. 3, a process implemented by processor 36 of an earbud 24 is illustrated. In particular, a device 10 transmits an audio signal to an earbud 24 that includes a speaker 310 and a microphone 315. Speaker 310 plays an audio signal for the user and the microphone 315 receives the audio signal as it is bounced around within the user's ear. The processor 36 is coupled to the speaker 310 and microphone 315 to execute operations. In particular, as will be described hereinafter, these operations include: determining a ratio of an energy estimation of the speaker audio signal to an energy estimation of the audio signal received by the microphone 315 (e.g., blocks 340, 370); determining a gain (e.g., block 380) for the speaker audio signal based upon the ratios; and based upon the gain, selecting a shelving filter (e.g., block 382).

To begin with, the process first receives the audio signal at decision block 300, where it is determined whether the adaptive equalization (EQ) process is to be implemented. If not, it is bypassed. If the adaptive EQ process is to be implemented, then at block 302, the adaptive EQ process is implemented as will be described. This bypass may be utilized with the system to help stabilize it, but is not necessary.

In order to implement the process under the control of the processor, the audio signal to the speaker is analyzed both at low frequency and high frequency. Looking first at low frequency analysis (e.g., 10-1000 Hz), the audio signal is filtered by a low frequency bandpass filter 330. Next, the filtered signal undergoes energy estimation 332 to determine an energy estimation of the audio signal. This energy estimation may be an averaging energy estimate over a pre-defined period of time for the audio signal. It should be appreciated that a FIR and/or IIR filter may be utilized to estimate a moving average energy estimate. The energy estimate may then be smoothed at smoothing block 334. Smoothing is beneficial in that it provides a more stable estimate. The smoothed energy estimate is then transmitted to ratio block 340, as will be described.

Simultaneously, an energy estimation of the audio signal at low frequency received by the microphone 315 is estimated. First, at block 320, it is determined whether an audio signal is present. If not, the adaptive EQ process or algorithm is bypassed (block 322). This bypass may be utilized with the system to help stabilize it (i.e., if microphone 315 becomes non-operational), but is not necessary. However, if the audio signal is received by the microphone 315, the audio signal is filtered by a low frequency bandpass filter 324. Next, the filtered signal undergoes energy estimation 326 to determine an energy estimation of the audio signal. This energy estimation may be an averaging energy estimate over a pre-defined period of time for the audio signal. It should be appreciated that a FIR and/or IIR filter may be utilized to estimate a moving average energy estimate. The energy estimate may then be smoothed at smoothing block 328. Smoothing is beneficial in that it provides a more stable estimate. The smoothed energy estimate is then transmitted to ratio block 340.

At block 340, a ratio of the energy estimation of the speaker audio signal from the speaker 310 to the energy estimation of the audio signal received by the microphone 315 is determined. This is denoted as speaker/microphone. Also, this is based upon low frequency bandpass filter energy estimates. This ratio of the energy estimation of the speaker audio signal from the speaker 310 to the energy estimation of the audio signal received by the microphone 315 is then smoothed by block 341 and is transmitted to the gain adjustment determiner 380, as will be described.

Simultaneous to the determining of the ratio of the energy estimation of the speaker audio signal to the energy estimation of the audio signal received by the microphone 315, at low frequencies, the same methodology is applied at high frequencies, as well (e.g., 1 K-10 K Hz). In this process, the audio signal is filtered by a high frequency bandpass filter 360. Next, the filtered signal undergoes energy estimation 362 to determine an energy estimation of the audio signal. This energy estimation may be an averaging energy estimate over a pre-defined period of time for the audio signal. It should be appreciated that a FIR and/or IIR filter may be utilized to estimate a moving average energy estimate. The energy estimate may then be smoothed at smoothing block 364. Smoothing is beneficial in that provides a more stable estimate. The smoothed energy estimate is then transmitted to ratio block 370, as will be described. Similarly, an energy estimation of the audio signal at high frequency received by the microphone 315 is estimated. The audio signal is filtered by a high frequency bandpass filter 350. Next, the filtered signal undergoes energy estimation 352 to determine an energy estimation of the audio signal. The energy estimate may then be smoothed at smoothing block 351. The smoothed energy estimate is then transmitted to ratio block 370.

At block 370, a ratio of the energy estimation of the speaker audio signal from the speaker 310 to the energy estimation of the audio signal received by the microphone 315 is determined. This is denoted as speaker/microphone. This is based upon high frequency bandpass filter energy estimates. This ratio of the energy estimation of the speaker audio signal from the speaker 310 to the energy estimation of the audio signal received by the microphone 315 is then smoothed by block 371 and is transmitted to the gain adjustment determiner 380.

The gain adjustment determiner 380 determines a gain that should be applied to the speaker audio signal for output by the speaker 310 such that the received audio signal (as heard by the microphone 315) is equalized and substantially the same as the intended speaker audio signal out of the speaker 310 (i.e., it is adaptively equalized (block 302)). The gain for the speaker audio signal is determined by both the ratios of the energy estimates of the speaker to the energy estimation of the audio signal received by the microphone both at the low frequency level (block 340) and at the high frequency level (block 370). Also, it should be noted that cross-correlation 318 may be utilized between the speaker and microphone signals in order to prevent the process from adjusting the gain on signals picked up by the error microphone 315 that do not originate from the speaker (e.g., background noise, user's voice, etc.).

Figure 4:
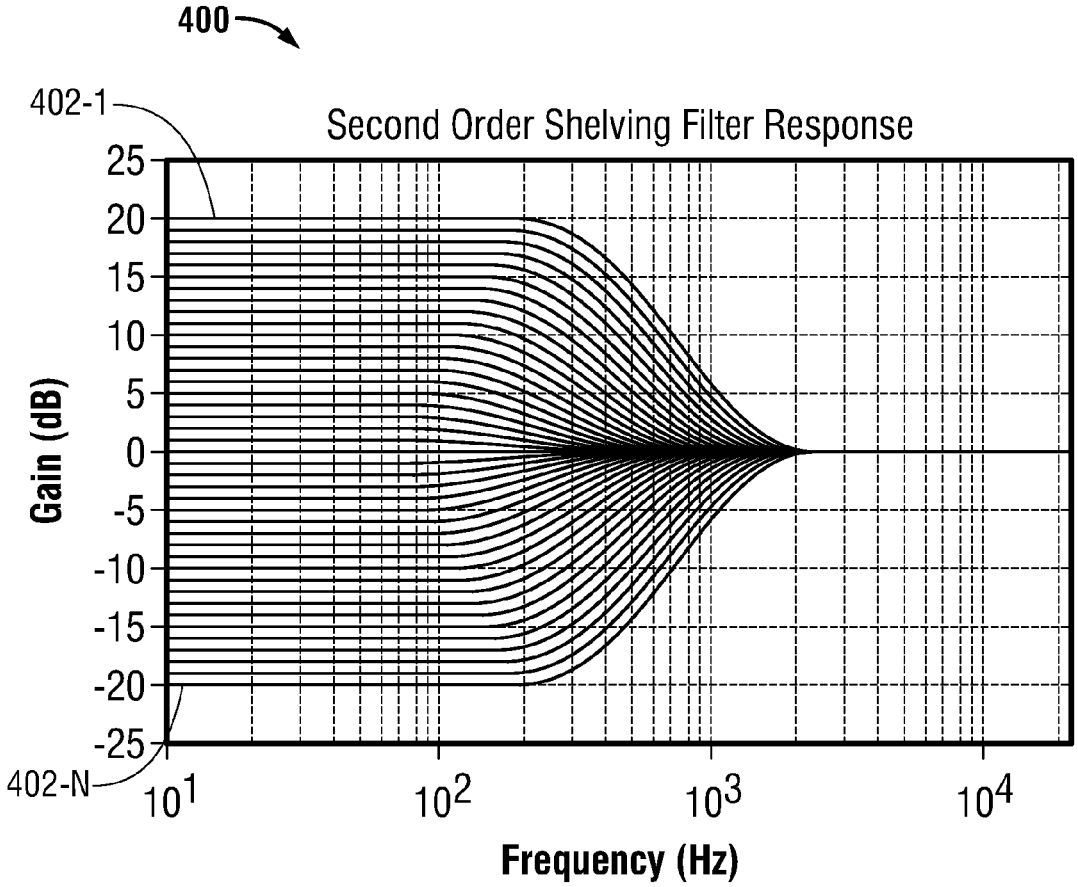
FIG. 4 is a chart illustrating selectable shelving filters, according to one embodiment of the invention.

Based upon the desired gain, at block 382, the processor selects an appropriate shelving filter to obtain the desired gain. As an example, the shelving filter may be a second order shelving filter. With additional reference to FIG. 4, as shown by graph 400, a range of shelving filters 402-1 through 402-N may be selected to obtain the desired gain. Continuing with process, at block 384 of FIG. 3, the selected shelving filter is applied in the adaptive equalization 302 such that the received audio signal (as heard by the microphone 315) is equalized and substantially the same as the intended speaker audio signal out of the speaker 310 (i.e., it is adaptively equalized (block 302)).

Accordingly, this previously described process may take advantage of the fact that most of the frequency response invariability at the Drum Reference Point (DRP) occur at the low frequencies. Typically, above 2 kHz, the frequency response remains stable with different fits in the ear—and therefore different amounts of occlusion. However, problems mainly occur at the low frequencies. Therefore, a low-frequency shelving filter (e.g., 402-1 through 402-N) may be applied in order to compensate for the invariabilities in the frequency response. The shelving filter may have a fixed cut-off frequency of about 1 kHz. The amount of gain applied to lower frequencies depends on the amount of occlusion. As previously described, the microphone 315 may be used in order to estimate the amount of gain to be applied to the low frequencies. In order to obtain this estimate, the process may consider the amount of energy in the low frequencies (e.g., from 100 Hz to 1 kHz) in both the speaker signal that is being sent out from the speaker 310 and the received signal at the microphone 315. The smoothed ratio of the energy estimates of these two signals may determine the amount of gain to be applied. After the amount of needed gain is determined, the low-frequency shelving filter is selected and applied to the speaker signal. The equalized speaker signal may be sent out in order to compensate for the gain/loss of the occlusion associated with the headphone and the user's ear.

Figure 5:
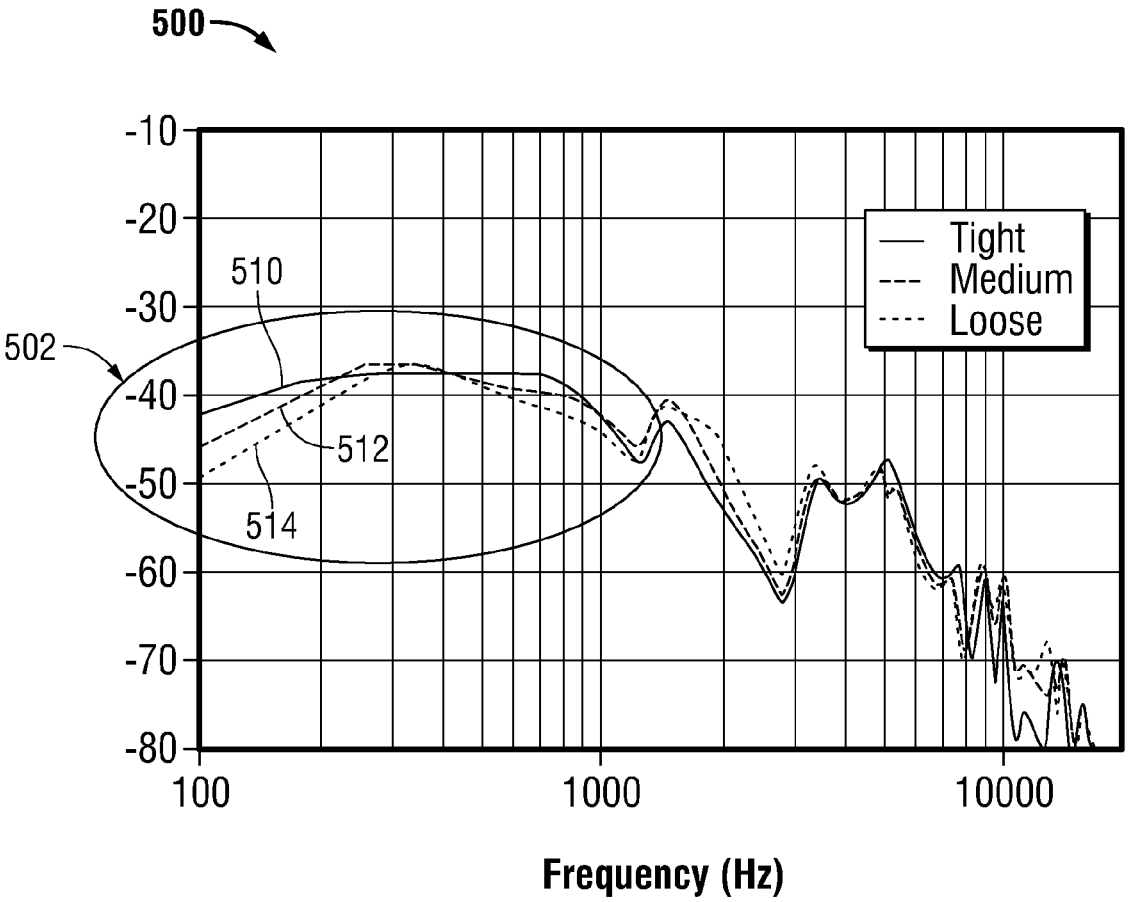
FIG. 5 is a chart illustrating reduced variances when embodiments of the invention related to adaptive EQ are implemented.

As an example, as can be seen with additional reference to FIG. 5, when the previously-described process is implemented, the graph 500 shows that the variances (y-axis) between the desired outputted audio signal and the received audio signal based on the equalization method for tight-fit earbuds 510, medium-fit earbuds 510, and loose-fit earbuds (see circle range 502), at the lower frequencies (x-axis), are relatively low and consistent with one another.

It should be appreciated that this methodology takes advantage of the fact that most of the frequency response invariability at the DRP occurs at the lower frequencies. Above 2 kHz, the frequency response remains stable with different fits in the ear—and therefore different amounts of occlusion. The problems remedied and addressed occur at the lower frequencies. Therefore, by utilizing the previously described low-frequency shelving filters that are applied in order to compensate for the invariability in frequency response, these problems can be addressed. The filters may have a fixed cut-off frequency of about 1 kHz, and above 2 kHz, may have a unity response. The amount of gain applied to lower frequencies depends upon the amount of occlusion. The microphone (built in the headphone in front of the driver) can be used in order to estimate the amount of gain to be applied to the low frequencies. It should be appreciated that the frequencies mentioned above are approximate, and are used to illustrate the principle aspects of the invention. It should also be appreciated that exact values will depend on the acoustics of the overall system including the ear, the earbud, the speaker, and the microphone.

In order to obtain this estimate, the previously-described process considers the energy estimates at both low frequencies and high frequencies in both the speaker signal that is being sent out and the received microphone signal. The smoothed ratio of energy estimates of these signals determines the amount of gain to be applied. After the amount of needed gain is determined, the low-frequency shelving filter is selected and applied to the speaker signal. The equalized signal being sent out applies the gain to compensate for loss of the occlusion. This process constantly (e.g., on a pre-determined time interval basis) estimates the energy levels of the signals, computes gains, and applies the correct shelving filter. The shelving filters used for compensation are predesigned and selected based upon the gain that needs to be applied.

It should be appreciated that aspects of the invention previously described may be implemented in conjunction with the execution of codes or instructions by a processor and/or other devices. Particularly, circuitry including but not limited to processors, may operate under the control of a program, routine, or the execution of instructions to execute methods or processes in accordance with embodiments of the invention. For example, such a program may be implemented in firmware or software (e.g. stored in memory and/or other locations) and may be implemented by processors and/or other circuitry. Further, it should be appreciated that the terms processor, microprocessor, circuitry, controller, etc., refer to any type of logic or circuitry capable of executing logic, commands, instructions, software, firmware, functionality, etc While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the audio system depicted in the figures may be a smart phone, digital media player, or a tablet computer, the audio system may alternatively be a different portable device such as a laptop computer, or even a non-portable device such as a desktop computer or a home entertainment appliance (e.g., digital media receiver, media extender, media streamer, digital media hub, digital media adapter, or digital media renderer). The description is thus to be regarded as illustrative instead of limiting.

What is claimed is:

1. An audio system comprising:

an earbud configured for insertion into a user's ear, the earbud including a speaker and a microphone, wherein the speaker is configured to receive and play an audio speaker signal for the user and the microphone is configured to output an audio microphone signal; and a processor coupled to the speaker and the microphone to determine a ratio of (1) an energy estimation of the audio speaker signal to (2) an energy estimation of the audio microphone signal, at low frequencies, determine a ratio of (1) an energy estimation of the audio speaker signal to (2) an energy estimation of the audio microphone signal, at high frequencies, wherein the high frequencies are within 1 kHz to 10 kHz, determine a gain based upon both the ratio at low frequencies and the ratio at high frequencies, based upon the gain, select a shelving filter, and apply the shelving filter to the audio speaker signal.

2. The system of claim 1, wherein the shelving filter is a low frequency shelving filter having a knee between 100 Hz and 1 kHz and wherein a gain of the shelving filter in the low frequencies is selected based on the determined gain.

3. The system of claim 1, wherein the shelving filter is an infinite impulse response (IIR) filter.

4. The system of claim 1, wherein the processor is to smooth a) the ratio at low frequencies of (1) the energy estimation of the audio speaker signal to (2) the energy estimation of the audio microphone signal, and b) the ratio at high frequencies of (1) the energy estimation of the audio speaker signal to (2) the energy estimation of the audio microphone signal.

5. The system of claim 1, wherein the processor determines the ratio at low frequencies and the ratio at high frequencies using bandpass filters wherein the low frequencies are within 100 Hz to 1 kHz and the high frequencies are within 1 kHz to 10 kHz.

6. A method comprising:

determining a ratio of (1) an energy estimation of an audio speaker signal that is input to a speaker of an earbud to (2) an energy estimation of an audio microphone signal that is output by a microphone of the earbud, at low frequencies;

determining a ratio of (1) an energy estimation of the audio speaker signal to (2) an energy estimation of the audio microphone signal, at high frequencies, wherein the high frequencies are within 1 kHz to 10 kHz, determining a gain based upon both the ratio at the low frequencies and the ratio at the high frequencies;

based upon the gain, selecting a shelving filter; and applying the shelving filter to the audio speaker signal.

7. The method of claim 6, wherein the shelving filter is a low frequency shelving filter having a knee between 100 Hz and 1 kHz and wherein a gain of the shelving filter in the low frequencies is selected based on the determined gain.

8. The method of claim 6, wherein the shelving filter is an infinite impulse response (IIR) filter.

9. The method of claim 6, wherein determining the gain based upon both the ratio at low frequencies and the ratio at high frequencies comprises smoothing the ratio at low frequencies and smoothing the ratio at high frequencies.

10. The method of claim 6, wherein determining the ratios at low frequencies and at high frequencies comprises filtering the audio speaker signal and the audio microphone signal using bandpass filters, wherein the low frequencies are within 100 Hz to 1 kHz and the high frequencies are within 1 kHz to 10 kHz.

11. A non-transitory processor-readable storage medium comprising codes executable by a processor to:

determine a ratio of (1) an energy estimation of an audio speaker signal that is input to a speaker of an earbud to (2) an energy estimation of an audio microphone signal that is output by a microphone of the earbud, at low frequencies;

determine a ratio of (1) an energy estimation of the audio speaker signal to (2) an energy estimation of the audio microphone signal, at high frequencies, wherein the high frequencies are within 1 kHz to 10 kHz;

determine a gain based upon both the ratio at low frequencies and the ratio at high frequencies;

based upon the gain, select a shelving filter; and apply the shelving filter to the audio speaker signal.

12. The non-transitory processor-readable storage medium of claim 11, wherein the shelving filter is a low frequency shelving filter having a knee between 100 Hz and 1 kHz and wherein a gain of the shelving filter in the low frequencies is selected based on the determined gain.

13. The non-transitory processor-readable storage medium of claim 11, wherein the shelving filter is an infinite impulse response (IIR) filter.

14. The non-transitory processor-readable storage medium of claim 11, further comprising code to smooth the ratio at low frequencies of (1) the energy estimation of the audio speaker signal to (2) the energy estimation of the audio microphone signal and code to smooth the ratio at high frequencies of (1) the energy estimation of the audio speaker signal to (2) the energy estimation of the audio microphone signal.

15. The non-transitory processor-readable storage medium of claim 11, further comprising code to bandpass filter the audio speaker signal and the audio microphone signal, when determining the ratios at low frequencies and at high frequencies, wherein the low frequencies are within 100 Hz to 1 kHz and the high frequencies are within 1 kHz to 10 Hz.

* * * * *